US010077171B2

(12) United States Patent
Chustz et al.

(10) Patent No.: US 10,077,171 B2
(45) Date of Patent: Sep. 18, 2018

(54) SAFETY BARRIER FOR VEHICLES AND CRANES

(71) Applicants: Grant C. Chustz, Torbert, LA (US); Michelle R. Chustz, Torbert, LA (US)

(72) Inventors: Grant C. Chustz, Torbert, LA (US); Michelle R. Chustz, Torbert, LA (US)

( * ) Notice: Subject to any disclaimer, the term of this patent is extended or adjusted under 35 U.S.C. 154(b) by 15 days.

(21) Appl. No.: 14/055,204

(22) Filed: Oct. 16, 2013

(65) Prior Publication Data

US 2014/0138339 A1 May 22, 2014

Related U.S. Application Data

(60) Provisional application No. 61/714,891, filed on Oct. 17, 2012.

(51) Int. Cl.
*B66C 15/06* (2006.01)
*B66C 23/78* (2006.01)

(52) U.S. Cl.
CPC ..... *B66C 15/06* (2013.01); *B66C 23/78* (2013.01)

(58) Field of Classification Search
CPC ..... B66C 23/78; B66C 23/80; B66C 23/88; E01F 13/022; E01F 13/028; B60J 11/00; B60J 11/02
USPC ..... 212/301–306; 280/762, 770, 763.1, 280/764.1, 765.1, 766.1; 224/401
See application file for complete search history.

(56) References Cited

U.S. PATENT DOCUMENTS 3,782,766 A * 1/1974 Teel ..... B60R 19/02 256/1
3,812,978 A * 5/1974 Roland et al. ..... 213/201
4,434,901 A * 3/1984 Gehl ..... 212/276
4,524,953 A * 6/1985 Phillips et al. ..... 256/23
4,844,420 A * 7/1989 Oster ..... B65H 75/38 160/24
5,050,846 A * 9/1991 Goodman ..... E01F 13/028 256/1
6,102,373 A * 8/2000 Amsinger ..... 256/1
6,135,423 A * 10/2000 Johnson ..... E01F 13/028 256/1
6,170,609 B1 * 1/2001 Dech ..... 182/187
8,707,595 B2 * 4/2014 Beemsterboer ..... B65H 75/425 40/515
9,045,881 B1 * 6/2015 Schlueter ..... E02F 9/24
(Continued)

*Primary Examiner* — Minh Truong
*Assistant Examiner* — Juan J Campos, Jr.
(74) *Attorney, Agent, or Firm* — Warner J. Delaune; Baker Donelson, et al.

(57) ABSTRACT

In a vehicle having a stationary frame and a rotating upper body, and wherein the frame includes a plurality of outriggers with pads, a safety barrier is provided, comprising a barrier support member attached to each of the pads, and extending away from the vehicle, wherein the support member includes an upper section adapted to retain a flexible barrier; and a flexible barrier attached across the upper sections of the support members to establish a safety perimeter around the vehicle. A storage rack is also provided for retaining the support members when not attached to the pads, wherein the rack includes a upper bracket having a U-shaped portion adapted to attach to the vehicle; and a frame adapted to carry all of the support members, wherein the frame includes a retention member to retain the support members within the frame in a secured position.

9 Claims, 5 Drawing Sheets

(56) References Cited

U.S. PATENT DOCUMENTS

2008/0251625 A1* 10/2008 Bentley ..... B65H 75/4431
242/400

* cited by examiner

SAFETY BARRIER FOR VEHICLES AND CRANES

CROSS-REFERENCE TO RELATED APPLICATIONS

This application claims the benefit under 35 U.S.C. § 119(e) to provisional application Ser. No. 61/714,891, filed Oct. 17, 2012.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

1. Field of the Invention

The present invention relates to devices used to keep persons away from the swing radius of cranes and similar vehicles, and more particularly to such devices that can be attached directly to the outriggers used to stabilize the vehicle.

2. Description of Related Art

In many construction sites employing the use of cranes, pickers, and similar vehicles, many persons use barricade tape to establish a safety perimeter around the vehicle. The tape is most often wrapped around cumbersome cones or barrels, which is a tedious process, unsuitable in many instances, and not in compliance with applicable federal safety regulations, such as those promulgated by the Occupational Safety and Health Agency (OSHA). Applicable regulations affecting such situations can be found at U.S. Code of Federal Regulations, Title 29, Chapter XVIII, Part 1926, Section 1926.550 Cranes and Derricks, Subsection (a), paragraph (9), reading: "Accessible areas within the swing radius of the rear rotating superstructure of the crane, either permanently or temporarily mounted, shall be barricaded in such a manner as to prevent an employee from being struck crushed by the crane." Similar regulations are also provided at Section 1926.1424 regarding work area control.

The present invention is designed to establish a safety barrier around such vehicles such that persons in the vicinity will be aware of the potentially hazardous conditions near the vehicle. It is not possible to completely prevent persons from entering the established perimeter and becoming injured, but the safety barrier provides a prominent visual warning that such danger exists within the swing radius of the crane.

As will be understood, cranes and pickers are not always stationary, and they are often moved around a construction site to attend to tasks several times during the day. It can be quite inconvenient, and expensive in terms of man-hours, to dismantle and re-establish make-shift barricades, especially when barrels and other large objects are used around the crane. Accordingly, it is an object of this invention to provide a safety barrier which may be stored on the crane, readily constructed by the operator of the crane when needed, and moved along with the crane outriggers when the crane must move to another location.

What is needed is a safety barrier for cranes that avoids the use of heavy barrels or drums to retain barrier tape, and avoids having to drive stakes or rebar into the ground around the location of the crane. The invention should also avoid the use and movement of heavy barricade stands customarily employed. By defining a safety perimeter using the present invention, one can also avoid barricading off large areas which may conflict with the movement requirements of nearby workers at the site. The invention should be lightweight, highly portable, less expensive than prior methods, and quick to set up by the crane operator.

SUMMARY OF THE INVENTION

Therefore, in a vehicle having a stationary frame and a rotating upper body, and wherein the frame includes a plurality of outriggers with pads, a safety barrier is provided, comprising a barrier support member attached to each of the pads, and extending away from the vehicle, wherein the support member includes an upper section adapted to retain a flexible barrier; and a flexible barrier attached across the upper sections of the support members to establish a safety perimeter around the vehicle.

In a preferred embodiment, the support member includes a base adapted to secure the support member to the pad, and the base includes a U-shaped bracket adapted to receive a reinforcing plate on the pad, and further including a fastener to secure the base to the plate.

Preferably, the support member is a tubular member, and wherein the upper section is adapted to retain a warning flag.

More preferably, the upper section of the support member includes a vertical extension having upper and lower barrier retention plates.

In a preferred operating configuration, the support member, when secured to the reinforcing plate of the pad, extends away from the vehicle at an angle of about 45 degrees from horizontal.

In a preferred operating configuration, the support member, when secured to the reinforcing plate of the pad, extends away from the vehicle such that the upper section of the support member is at least 3 feet from the pad.

The support member preferably includes a lockable pivot allowing the support member to be folded for storage, and allowing the support member to be locked in an extended position for operation.

The invention further comprises a storage rack for retaining the support members when not attached to the pads, wherein the rack includes a upper bracket having a U-shaped portion adapted to attach to the vehicle; and a frame adapted to carry all of the support members, wherein the frame includes a retention member to retain the support members within the frame in a secured position.

Most preferably, the safety barrier of the present invention conforms to a plurality of regulations regarding the establishment of a safety perimeter around a swing radius of the vehicle.

The above and other objects and features of the present invention will become apparent from the drawings, the description given herein, and the appended claims.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

Before the subject invention is further described, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this invention belongs.

Figure 1:
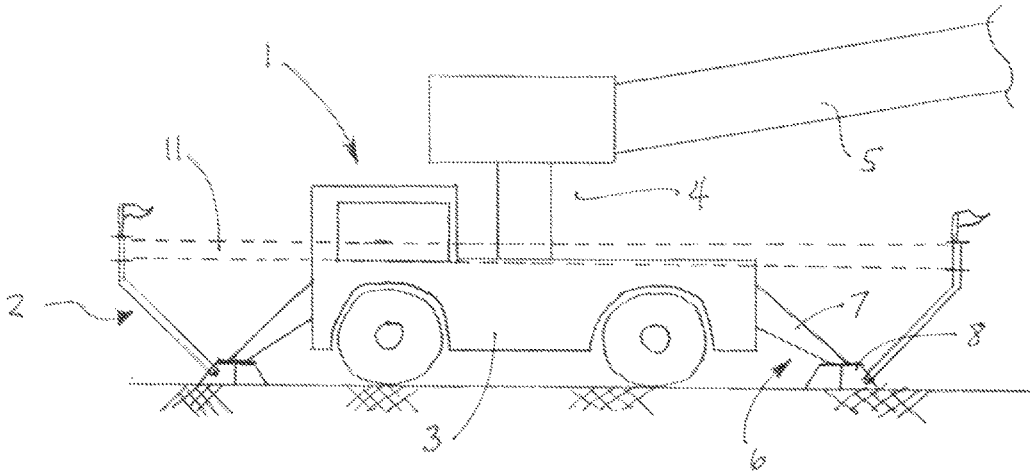
FIG. 1 shows a side view of a typical vehicle or crane with a preferred embodiment of the present invention installed in an operating configuration.
Figure 2:
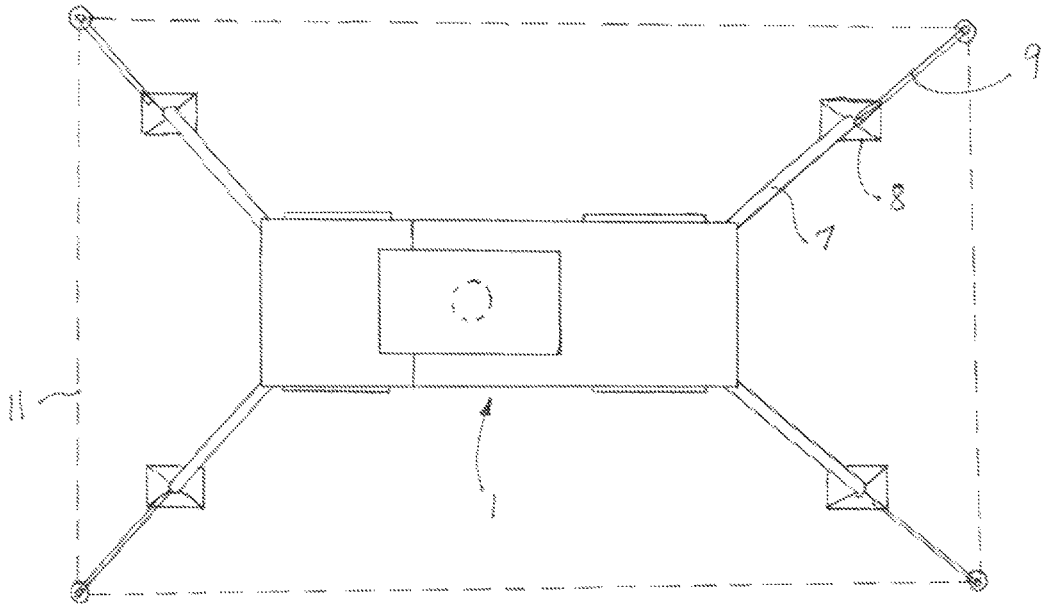
FIG. 2 shows a top view of the embodiment of FIG. 1 depicting the safety perimeter established around the vehicle.

Referring now to the drawings, and in particular FIG. 1, a side view is shown of a typical vehicle or crane 1 with a preferred embodiment of the safety barricade 2 installed in an operating configuration. The crane 1 will typically include a stationary frame 3 and an upper body 4 having a boom 5 that rotates relative to the frame 3. Outriggers 6 are located at four points around the crane 1, and each outrigger is comprised of an outrigger extension 7 and a pad 8 which contacts the surrounding terrain. Although a wheel-based crane 1 is depicted, any other vehicle having similar mobility, including tracked vehicles, may also benefit from the invention.

Figure 3:
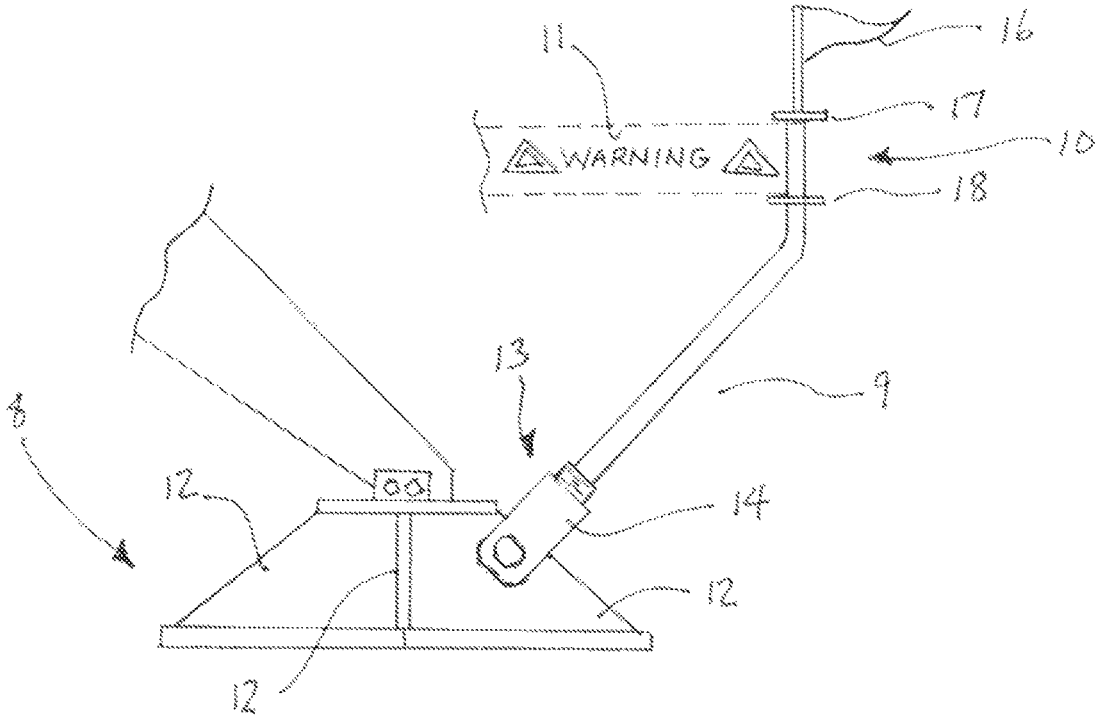
FIG. 3 shows a side view of the support member attached to the pad of an outrigger.
Figure 4:
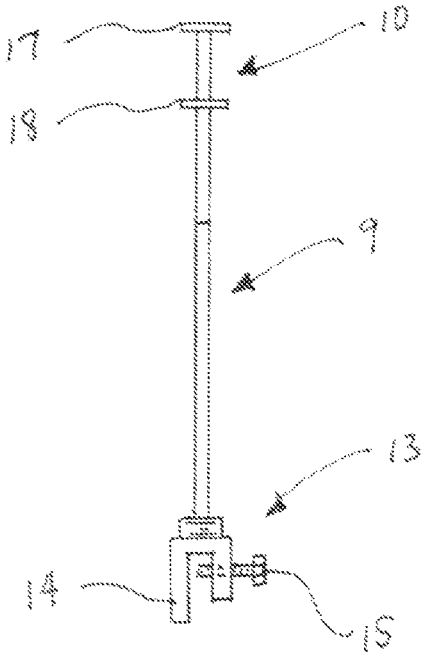
FIG. 4 shows a front view of the support member.

The safety barrier 2 generally comprises a barrier support member 9 attached to each of the pads 8, and extending away from the crane 1. With reference to FIGS. 3 and 4, each the support member 9 includes an upper section 10 adapted to retain a flexible barrier 11. In its installed configuration, the flexible barrier 11 is attached across the upper sections 10 of the support members 9 to establish a safety perimeter around the crane 1. In most cases, the pad 8 includes several reinforcing plates 12 which strengthen the pad. Therefore, in a preferred embodiment, the support member 9 includes a base 13 adapted to secure the support member 9 to the pad 8, and the base 13 includes a U-shaped bracket 14 adapted to receive the reinforcing plate 12 on the pad 8. A hole is formed into the reinforcing plate, and a fastener 15, such a threaded bolt and nut, is used to secure the base 13 to the plate 12.

In a preferred embodiment, the support member 9 is a tubular member. As such, the upper section 10 can accommodate a warning flag 16 inserted into the hollow interior of the support member 9. Furthermore, the upper section 10 of the support member 9 includes a vertical extension having upper and lower barrier retention plates 17, 18. These retention plates 17, 18 can be washers welded to the upper section, and they provide a simple and effective means for retention of barrier rope or barrier tape 11.

In an optional embodiment, the support member 9 may include a lockable pivot allowing the support member 9 to be folded for storage, and allowing the support member 9 to be locked in an extended position for operation. The lockable pivot may be a hinge roughly midway between the base 13 and the upper section 10, and may be secured in either position by a sleeve or channel secured to the support member 9 by conventional fasteners.

In an operating configuration, the support members 9, when secured to the reinforcing plates 12 of the pad 8, extend away from the crane 1 at an angle of about 45 degrees from horizontal, and at least three feet (3') from the pad 8.

Figure 5:
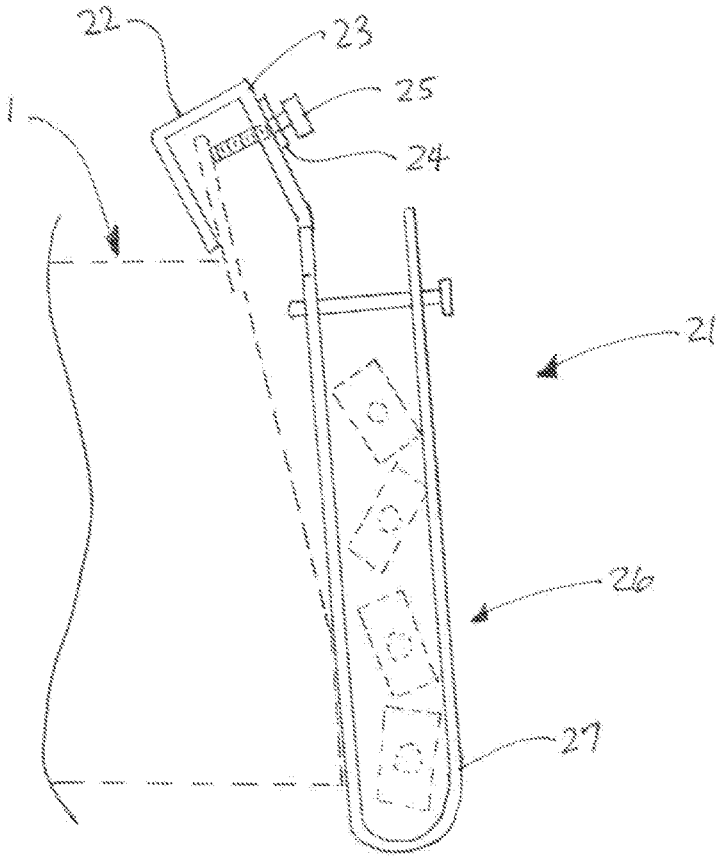
FIG. 5 shows a side view of the storage rack in position on the vehicle and carrying the support members.
Figure 6:
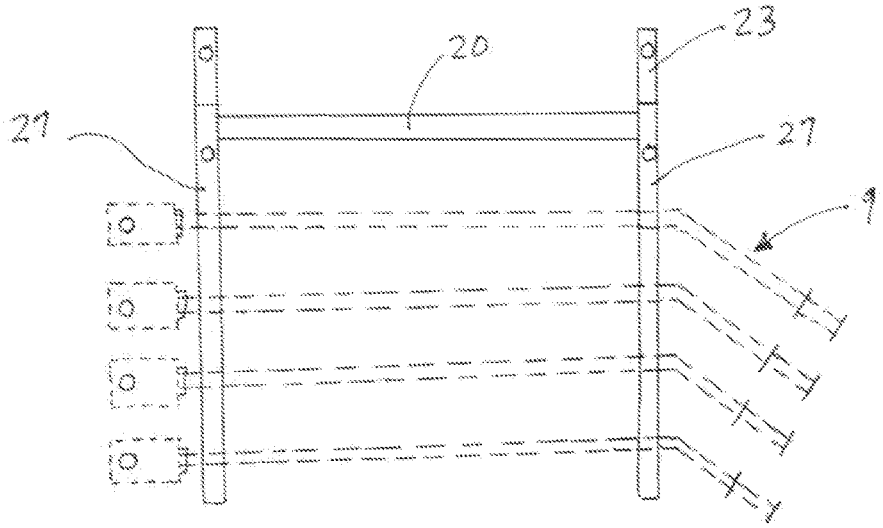
FIG. 6 shows a front view of the storage rack of FIG. 5.

With reference to FIGS. 5 and 6, the invention further comprises a storage rack 21 for retaining the support members 9 when not attached to the pads 8. The rack 21 includes a pair of upper brackets 22 having a U-shaped portion 23 adapted to attach to the crane 1. The brackets 22 are secured to one another by a crossbar 20. A threaded nut 24 can be welded to the U-shaped portion 23, which accommodates a bolt 25, permitting the rack 21 to be secured to the crane 1 by tightening the bolt 25 against an available edge on the crane 1. The rack 21 further includes a frame 26 adapted to carry all of the support members 9. The frame 26 includes a pair of frame members 27 which are curved upward to hold the support members 9 in a secured position.

Figure 7:
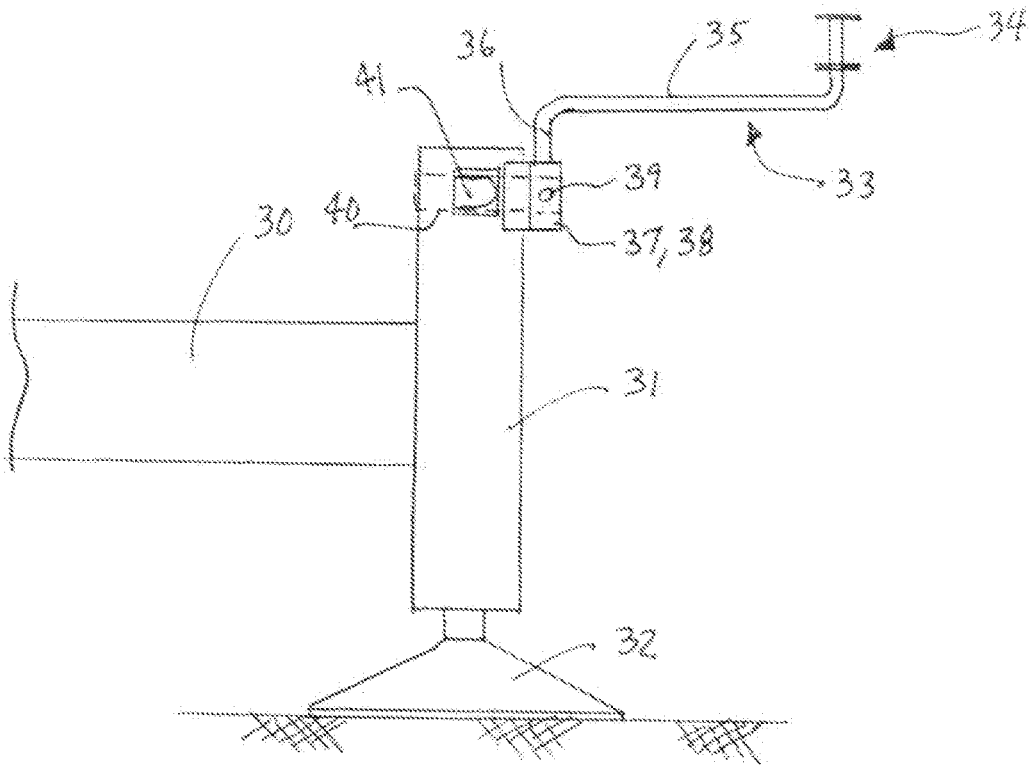
FIG. 7 shows an alternative embodiment of the invention adapted to other vehicles.
Figure 8:
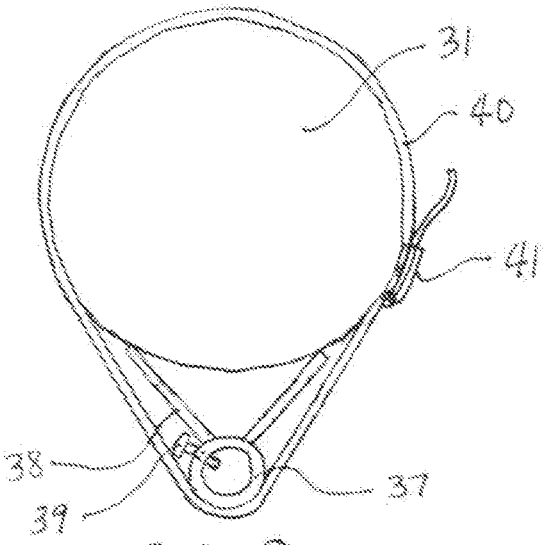
FIG. 8 shows a detailed view of the attachment method of FIG. 7.

With reference to FIGS. 7 and 8, an alternate embodiment of the invention is shown to be adaptable to other cranes 1 and their respective outriggers. For example, an outrigger 30 extends from the crane and includes a column 31 having a pad 32. In this version, the support member 33 comprises an upper portion 34 identical to the support member 9 of FIG. 3, but also includes a horizontal portion 35 and a base portion 36. The base portion 36 fits into a socket 37 welded outside the apex of an angle member 38 having two plates in contact with the outrigger column 31, and is secured by a pin 39. The socket and angle member 37, 38 are removably attached to the column 31 by an adjustable strap 40 which is lockably adjustable by a quick-release buckle 41. When the support members 33 are secured to all four columns 31 of the outriggers 30, the invention provides the identical function as explained previously herein.

Figure 9:
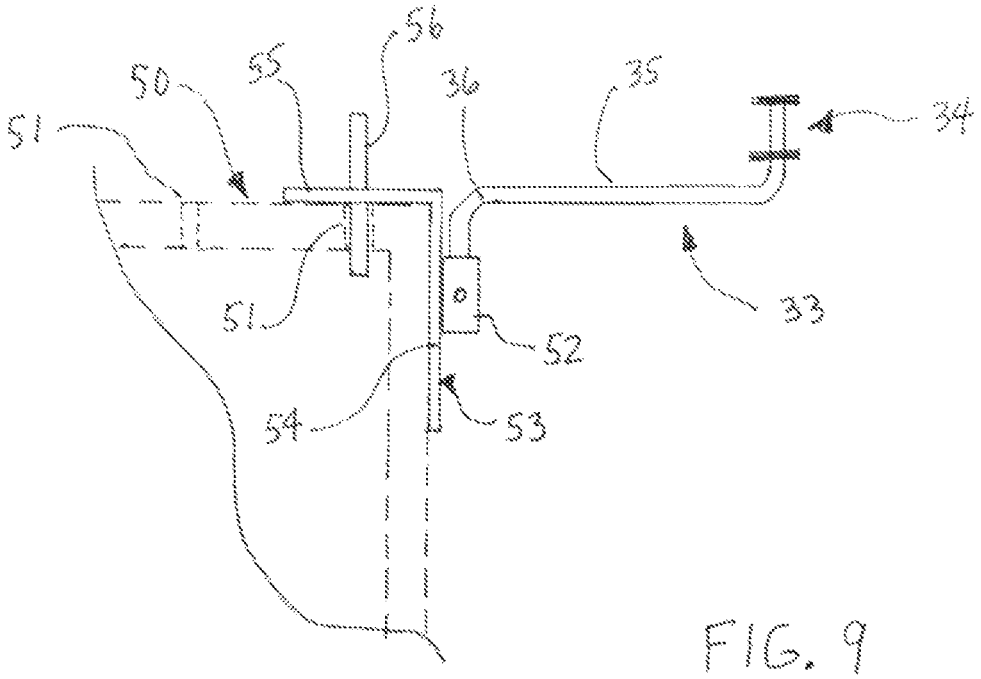
FIG. 9 shows a further alternative embodiment for cranes with perforated decks.

With respect to FIG. 9, another alternative embodiment of the invention is shown to be adaptable to cranes 1 which have perforated decks 50. In this example, the deck 50 includes a number of holes or perforations 51 which allow various items to be secured to the deck 50. Thus, the invention adapted to this type of crane 1 includes the same support member 33 as in FIG. 7, and which is secured into a socket 52 welded to an angle bracket 53. The based portion 36 is secured into the socket 52 by a pin 39. The angle bracket 53 includes a vertical plate 54 and a horizontal plate 55, wherein the horizontal plate 55 further includes a vertical post 56. The vertical post 56 is inserted into the hole 51 on the deck 50, while the angle member 53 provides lateral stability for the support member 33.

Most preferably, the safety barrier of the present invention conforms to a plurality of regulations regarding the establishment of a safety perimeter around a swing radius of the vehicle, and particularly to those regulations referred to elsewhere herein.

All references cited in this specification are herein incorporated by reference as though each reference was specifically and individually indicated to be incorporated by reference. The citation of any reference is for its disclosure prior to the filing date and should not be construed as an admission that the present invention is not entitled to antedate such reference by virtue of prior invention.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only, and the scope of the present invention is to be limited only by the following claims.

The invention claimed is:

1. In combination with a vehicle having a stationary frame and a rotating upper body, and wherein the frame includes a plurality of outriggers with pads, a safety barrier, comprising:

(a) a barrier support member attached to each of the pads, and extending away from the vehicle, wherein the barrier support member includes an upper section adapted to retain a single flexible barrier, wherein the upper section of the barrier support member includes a vertical extension having upper and lower barrier retention plates, and wherein the upper and lower barrier retention plates each comprise a flat washer in a substantially horizontal orientation and substantially parallel to one another; and (b) the single flexible barrier attached across and in contact with a plurality of upper sections of the barrier support members and retained between the upper and lower barrier retention plates to establish a safety perimeter around the vehicle;

wherein the barrier support member includes a base adapted to secure the barrier support member to the pad; and wherein the base of each of the barrier support members includes a U-shaped bracket removably attachable to a reinforcing plate on the pad, and further including a fastener to secure the base to the reinforcing plate.

2. The safety barrier of claim 1, wherein the barrier support member is a tubular member, and wherein the upper section is adapted to retain a warning flag.

3. The safety barrier of claim 1, wherein the barrier support member, when secured to the reinforcing plate of the pad, extends away from the vehicle at an angle of about 45 degrees from horizontal.

4. The safety barrier of claim 1, wherein the barrier support member, when secured to the reinforcing plate of the pad, extends away from the vehicle such that the upper section of the barrier support member is at least 3 feet from the pad.

5. The safety barrier of claim 1, further comprising a storage rack for retaining a plurality of barrier support members, wherein the storage rack includes:

(a) an upper bracket having a U-shaped portion removably attachable to the vehicle; and (b) a rack frame attached to the upper bracket adapted to carry the plurality of barrier support members, wherein the rack frame includes a retention member to retain the plurality of barrier support members within the rack frame in a secured position.

6. The safety barrier of claim 1, wherein the safety barrier conforms to a plurality of regulations regarding the establishment of the safety perimeter around a swing radius of the vehicle.

7. In combination with a crane vehicle having a frame and a rotating crane, and wherein the crane vehicle includes a plurality of outriggers with pads, a safety barrier, comprising:

(a) a plurality of extendable barrier support members, each of the barrier support members having an upper portion which includes upper and lower barrier retention plates, wherein the upper and lower barrier retention plates each comprise a flat washer in a substantially horizontal orientation and substantially parallel to one another, and wherein the barrier support members each include a base portion removably securable to the crane vehicle; and (b) a single flexible barrier attached across and in contact with a plurality of upper portions of the barrier support members and retained between the upper and lower barrier retention plates to establish a safety perimeter around the crane vehicle;

wherein the barrier support member includes a base adapted to secure the barrier support member to the pad; and wherein the base of each of the barrier support members includes a U-shaped bracket removably attachable to a reinforcing plate on the pad, and further including a fastener to secure the base to the reinforcing plate.

8. The safety barrier of claim 7, wherein the barrier support member is a tubular member, and wherein the upper portion is adapted to retain a warning flag.

9. The safety barrier of claim 7, wherein the barrier support member, when secured to the crane vehicle, extends away from the crane vehicle such that the upper portion of the barrier support member is at least 3 feet from the base portion.

* * * * *